Figure 2:
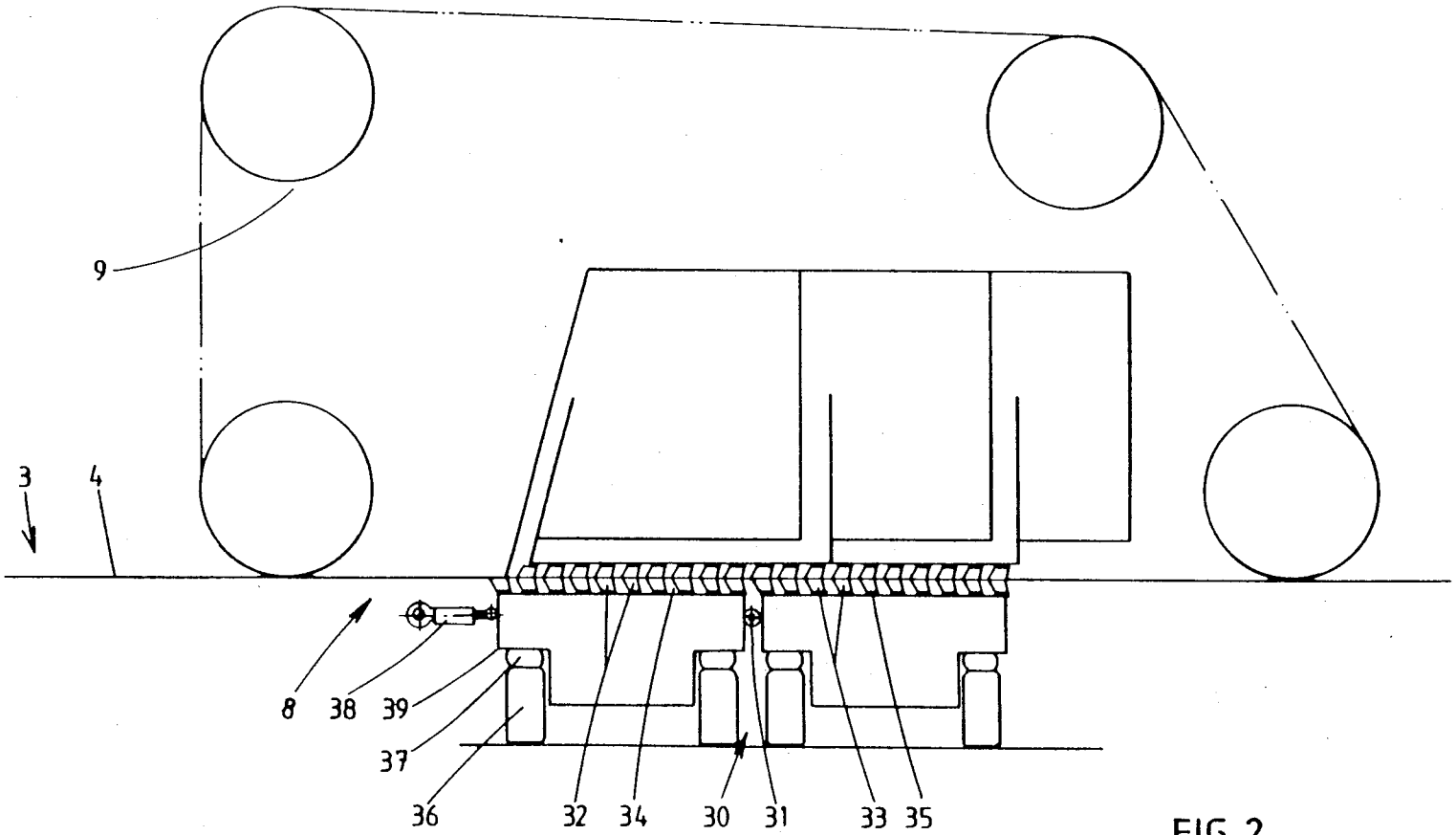

moved, with the cassette 205 left in the address label recovery section 28.

FIG. 36 shows the construction of the address label recovery section 28. Numerals 28, 208, 209 and 212 correspond with like parts in FIG. 35. Numeral 214 refers to a base plate of the address label recovery section; 215 to a notch provided on the base plate 214; 216 to a window provided on the address label recovery section; and 217 and 218 to magnets for driving label supports, respectively.

A cassette 2–5 shown in FIG. 37 is set on the base plate 214 in the address label recovery section 28 shown in FIG. 36. The cassette 205 has a notch 219 and a window 220. The notch 219 corresponds with the notch shown in FIG. 36, and the window 220 with the window 216 shown in FIG. 36. The depth of the notch 219 shown in FIG. 37 is made smaller than the depth of the notch 215 shown in FIG. 36 so that the notch 219 can be lifted upward from under by a hand to remove the entire cassette 205.

A base plate 206 shown in FIG. 37 is placed on the bottom surface of the cassette 205 in such a manner that the notch 221 provided on the base plate 206 agrees with the notch 219 provided on the cassette 205. The depth of the notch 221 shown in the figure is made smaller than the depth of the notch 219 so that when the address label stack has a small number of labels, the notch 221 can be manually lifted upward from under to remove the base plate 206 from the cassette 205. A blind plate 207 is provided to close the window 220 provided on the cassette 205. If the address label stack has a small number of labels, the window 220 is used for inserting a hand to remove the label stack, together with the base plate 206, as described above. If the window 220 is left open, the air present under the address label 23 may escape from the window 220, with the consequence that the address label 23, which slides on the sliders 203 and 204 into the cassette 205, would unwantedly sag at the tip thereof, leading to failure of the address label 23 to stably land onto cassette 205. The blind plate 207 is used to normally close the window 220 to improve the landing performance of address labels 23 onto the cassette 205.

(VIII) Essential Parts Relating to Printing of Bar Codes on Address Labels

As shown in FIGS. 3A, 3B and 4, the address label 50 has bar codes printed on the four corners thereof, so that the information on the address label can be read from the bar codes. The bar codes are printed by the printing head shown in FIG. 2. The format in which bar codes are printed is determined by the instruction received by the printing controller from the line editing buffer controller 9.

If a number of bar code patterns representing various types of information are stored in the memory, from which a desired code pattern is selected for printing, an enormous memory capacity would be required because there are a large number of bar code patterns involved.

This invention is also intended to solve this problem. In the following, bar code printing according to this invention will be described.

FIG. 38 shows the construction of the essential parts of the line editing buffer controller 9 shown in FIG. 1. Numerals 5, 9, 10 and 11 in the figure correspond with like part in FIG. 1. Numeral 222 refers to an internal control unit; 223 to a memory; and 224 to an editing means, respectively.

In the following, the embodiment shown in FIG. 38 will be described in detail, referring to FIGS. 39 through 41.

In FIG. 38, the processor 5 is used for inputting character information on bar codes being output and editing information for output layout. The editing information consists of font address information showing locations for a compiled sub bit pattern (see FIG. 40) stored in the memory 223 and/or or a bar-code bit pattern (see FIG. 41), print address information showing locations for bar codes being printed by the printing controller, directional information showing printing direction, and magnification information (magnification factor and point number) showing the size of the bar codes being printed.

The sub bit pattern stored in advance in the font memory 10 is a bit pattern table in which black bars of a bar code corresponding to characters (0 through 9, and "start" and "stop" in the embodiment shown in FIG. 39) being output are represented by "1s", and spaces between black bars by "0s", and the bits whose number is proportional to the widths of the black bars and the spaces are arranged in a one-dimensional array. The embodiment shown in FIG. 39 represents a sub bit pattern where the types of bar codes being output are expressed in the so-called "2 out of 7" mode, and a bit pattern corresponding each character is composed of 32 or 16 bits. At the end of bit patterns, added are a plurality of "0" bits (underlined portions in FIG. 39), which are disregarded when compiling a compiled sub bit pattern, as will be described later, referring to FIG. 40. In the following, the construction shown in FIG. 38 will be described.

(1) First, character information and editing information, as described above, are input in the processor 5.

(2) The internal control unit 222 transfers the editing information to the editing means 224, and, based on the character information, generates a compiled sub bit pattern and/or bar-code bit pattern corresponding to the character information for storage in the memory 223. In the following, the processing for generating the bar-code bit pattern will be described taking an example.

(2-1) Assume that the bar code being output represents a value "12". Then, the internal control unit 222 extracts bit patterns corresponding to "1", "2", "start and stop" from the sub bit pattern table (shown in FIG. 39) stored in the font memory 10, compiles a compiled sub bit pattern (shown in FIG. 40) by interposing "0s" corresponding to the predetermined number bits between each bit pattern and arranging the bit patterns in a one-dimensional array (in the Y direction shown in FIG. 40). The compiled sub bit pattern shown in FIG. 40 is compiled so that the total number of bits is an integral multiple of 16 bits by adding an appropriate number of "0" bits to the end of the bit patterns.

(2-2) Next, the internal control unit 222 expands each bit in the abovementioned compiled sub bit pattern into a two-dimensional array to produce a bar-code bit pattern shown in FIG. 41, and stores the compiled sub bit pattern and/or the bar-code bit pattern in the memory 223. The number of two-dimensional bits in the bar-code bit pattern shown in FIG. 41 can be of a size of (16 bits×6)×(8 bits×8). Space frames in FIG. 41 represent "0" bits.

(3) In the meantime, the editing means 224 performs the following editing processing on the basis of the editing information transferred via the internal control

SUPPORT APPARATUS FOR A DEWATERING UNIT IN THE WEB FORMING SECTION OF A PAPER MACHINE

The present invention relates to support apparatus for a dewatering unit in the web-forming section of a paper machine and especially to the supporting of a dewatering unit below a bottom wire, said unit being used in connection with a twin wire former. This supporting method allows a wide range of adjustments to be made.

There are several known shoe constructions for the forming section of a twin wire former, most of which are stationary and quite stiff. Some vertically adjustable constructions have, however, been disclosed, for example in U.S. Pat. No. 3,994,774, FI Pat. No. 69885 and DE Pat. No. 3406217.

U.S. Pat. No. 3,994,774, although it relates to a so-called gap former, discloses vertical adjustment of the lower dewatering unit by means of pressure-medium filled cylinders disposed in the corners of said lower unit. Such arrangement enables stepless adjustment of the inclination of the lower dewatering unit.

FI Pat. No. 69885 discloses a forming shoe for a twin wire forming section in a paper machine, said shoe comprising a number of pivoted blade rows disposed transversely with respect to the forming shoe. The height of each forming shoe is separately adjustable in order to provide a leading surface of a desired form. Articulation of the blade rows allows forming of a curved leading surface comprising several partial plane-like surfaces.

In DE Pat. No. 3406217, the cover of a dewatering unit below a bottom wire is formed of lists, each of which is adjustable to compress the web against the dewatering unit above the bottom wire at pressure unequal to that of other rows. In the embodiment disclosed in said patent, the rows are attached to a flexible membrane, below which a desired pressure prevails. Dividing the pressurized space below the membrane into separate chambers makes it possible to change the state of pressure in the chambers, which enables the comprssive effect on the web to be adjusted. The more chambers the pressurized space is divided into, the greater the number of unequal compressive pressures that can be used.

The above described, relatively advanced arrangements have some disadvantages that cannot be eliminated because of their constructions. Neither is it possible to apply the newst technique in them such as, for example, provision of dewatering elements, disposed on different side of the web, that are adjustable with respect to one another in the longitudinal direction of the web.

Although the arrangement as disclosed in U.S. Pat. No. 3,994,774 allows vertical adjustment in the lower dewatering unit, such arrangement is not readily applicable to said unit. Disposition of pressure-medium filled cylinders in the corners of the lower unit also sets too high demands on the stiffness of said unit, at least if the width of the unit exceeds five meters.

Although every blade can be vertically adjusted independently of each other if FI Pat. No. 69885, it seems unlikely that such an adjustment could be made during operation or that such a unit would be adjustable in the direction of the web. Furthermore, in view of a wide paper machine, lack of stiffness constitutes a problem also in this arrangement if said type of shoe is used as a counterpart of the upper dewatering unit.

Thirdly, the apparatus as disclosed in DE Pat. No. 34062127 has some disadvantages even though it is highly developed. Due to a complicated pressure-medium chamber and especially due to its adjustment and feed equipment, it is hard to imagine said apparatus being transferable in the direction of the web. It is also highly probable that if said arrangement were applied as a counterunit of a suction box, the cover of which is formed of foils, it would not function reliably because of a flexible attachment of the foils to the membrane covering the pressure-medium filled chamber. In that case, the foil/foils would most probably vibrate due to pressure pulses, thus not achieving the advantages that can be reached by means of stationary, fixed lists.

It is an object of the present invention to provide a dewatering unit and means of supporting thereof, which together eliminate or minimize the defects discovered in known arrangements. The result of the invention is a dewatering unit with means of support, which unit is readily and in a diversified manner adjustable, and is simple and reliable in operation, characterized in that the dewatering unit below the bottom wire is supported by hose-like pressure elements on beams disposed transversely with respect to the machine direction, said pressure elements enabling the dewatering unit to be adjusted both vertically and horizontally. Other characteristics of the apparatus are disclosed in the accompanying claims.

The apparatus will be further described, by way of example, with reference to the accompanying drawings, in which FIG. 1 is an overall schematic elevational view of the wet end of a paper machine to which the support apparatus according to the invention is applied; and FIG. 2 is a detailed side view of the apparatus in accordance with the invention which may be regarded as an enlarged fragmentary detail of FIG. 1.

FIG. 3 is an end elevational view of the support apparatus hereof.

The apparatus according to the invention is primarily intended to be used in a fourdrinier machine 1, as shown in FIG. 1. In its simplest form, the wet end of the fourdrinier machine 1 comprises a headbox 2 and a fourdrinier wire section 3, said wire section comprising and endless mesh loop or "wire" 4, breast rool 5, other rolls and rollers 6 and dewatering elements 7. The rear or downstream end of the fourdrinier wire section 3, i.e. a so-called web forming section 8, comprises an upper or "on-top" unit 9 above the web and a dewatering unit 30 below the fourdrinier wire or lower wire 3.

In the arrangement as shown in FIG. 2, the dewatering unit 30 of the web-forming section of the paper machine comprises two covers 34 and 35 formed by a row of rod-like elements 32 and 33 extending transversely of the wires, said covers being united by a joint 31. The covers 34 and 35 are supported on beams 36, said beams extending transversely with respect to the direction of extension of the machine and being attached to the machine frame through pressure-medium (compressed air, hydraulic fluid) filled expansible, flexible vessel means of hose-like elements 37 so as to enable longitudinal adjustment of the angular position of the covers 34 and 35 with respect to the machine. In other words, the pressure exerted by the covers 34 and 35 on the bottom wire 4 can be changed. The adjustability is achieved by the pressure adjustment of each hose-like pressure element 37 being independent of other elements 37. Furthermore, to improve the adjustability of the dewatering unit 30, the covers 34 and 35 are displaceably engaged or supported by an adjustable means of element 38 adjustable longitudinally with respect to the direction of extension of the machine, said element being attached to the machine frame at one end and to the cover 34 at its other end. Any other elements for the longitudinal adjustment are unnecessary because hose-like elements 37 provide a sufficient adjusting allowance both horizontally and vertically. if required, distances between various covers may be adjusted.

The advantage of hose-like elements 37 is that, even though the beams 36, disposed transversely with regard to the manchine, become bent due to the load on them, the hose-like elements 37 may be adjusted to keep the covers 34 and 35 in plane-like disposition. The hoses 37 also allow the covers 34 and 35 to be lowered to such an extent that, for example, changing of the rod-like elements 32 or 33 is facilitated. Furthermore, it is possible to make the hose-like elements 37 from a plurality of parts in the longitundinal direction of the beam 36, i.e. divide the hoses into a plurality of shorter parts, each of which can be independently pressure-adjusted. For example, as illustrated in FIG. 3, hose 37 is divided into a plurality of compartments 37*a*–37*d* in its longitudinal direction transverse to the direction of paper extension. Each compartment 37*a*–37*d* is a separate inlet pressurized fluid line under control of a discrete independently adjustable control valve 40*a*–40*d*. In this way, it is easier to adapt the form of the lower dewatering unit to that of the upper one.

If necessary, the pass of covers 34 and 35 can be limited by means of special limit plates 39 that prevent moving of the hose-like pressure element 37 from the top of the beam 36 during adjustments. Transverse movement of the covers 34 and 35 can be limited in many ways. It is possible, for example, to arrange slide surfaces on the side of the covers, said surfaces only allowing movement in the longitudinal direction with respect to the machine. Even though the above description illustrates a two-part cover of the dewatering unit 30, said cover can alternatively be made from one part or be assembled of several parts by joining them together. Also, even though the above description discloses the covers being composed of rod-like dewatering elements, they can be of any appropriate type. Furthermore, supporting of the sides adjacent to the covers 34 and 35 can be made so as to affect or achieve the joint between the covers.

Although in FIG. 2, the adjustable means 38 is illustrated as a pressure-medium filled cylinder, it may alternatively be a manual screw adjuster or any other appropriate adjusting device.

As can be seen from the above, by a simple construction and reliable operation the invention makes up a unit or whole, meeting all the objects required of. The above only discloses one preferred embodiment of the invention and is not intended to limit the invention from what is claimed in the accompanying claims.

We claim:

1. In a dewatering unit of a paper machine extending in a longitudinal direction, said dewatering unit positioned below a lower endless mesh web of the paper machine and including first and second longitudinally spaced covers, each cover formed of dewatering elements, each cover having opposite ends spaced one from the other in the longitudinal direction of the machine extension, a support apparatus for said covers comprising:

a plurality of first means for supporting said first cover along its opposite ends thereof spaced longitudinally one from the other with each first supporting means extending transversely with respect to the direction of the extension of the paper machine; and a plurality of second means for supporting said second cover along its opposite ends thereof spaced longitudinally one from the other with each said second supporting means extending transverse with respect to the direction of the extension of the paper machine, each said first and second supporting means including expansible flexible wall vessel means containing fluid under pressure and a beam disposed transversely with respect to the direction of extension of said paper machine, the expansible flexible wall vessel means of each end of said covers being supported on the corresponding beam; and joint means for joining said first and second covers one to the other, said expansible flexible wall vessel means supporting said covers through said joint means.

2. Apparatus according to claim 1 wherein each of said vessel means is divided into several compartments in a transverse direction.

3. Apparatus according to claim 2 including means for independently adjusting the pressure in each compartment of said vessel means.

4. Apparatus according to claim 1 wherein one of said vessel means is positioned on its ocrresponding beam to enable displacement of one of said covers longitudinally with respect to the direction of extension of the machine, said apparatus further including a stationary frame, and means connecting between said stationary frame and said one cover for displacing said one cover longitudinally.

5. Apparatus according to claim 4 wherein said displacing means is structured for being operable to displace both said first and second covers relative to said stationary frame.

6. Apparatus according to claim 5 wherein each of said vessel means is divided in a transverse direction into several parts.

7. Apparatus according to claim 6 including means for independently adjusting the pressure in each part of said vessel means.

8. Apparatus according to claim 1 wherein each of said first and second covers has four corners, said flexible wall vessel means being disposed adjacent each of the four corners of each said first and second cover, and means for adjusting the pressure of each said flexible wall vessel means adjacent each corner independently of one another.

* * * * *